US005195271A

United States Patent [19]

Bradley, Jr.

[11] Patent Number: 5,195,271

[45] Date of Patent: Mar. 23, 1993

[54] PLANT CONTAINER COVER

[76] Inventor: James B. Bradley, Jr., 4805 Inverness Dr., Tyler, Tex. 75703

[21] Appl. No.: 897,889

[22] Filed: Jun. 12, 1992

[51] Int. Cl.[5] ..... B65D 65/10

[52] U.S. Cl. ..... 47/72

[58] Field of Search ..... 47/72

[56] References Cited

U.S. PATENT DOCUMENTS

| | | | |
|---|---|---|---|
| 716,668 | 12/1902 | Cheney . | |
| 1,421,628 | 7/1922 | Watkins | 47/72 |
| 1,446,563 | 2/1923 | Hughes | 47/72 |
| 1,520,647 | 12/1924 | Hennegan . | |
| 1,610,652 | 12/1926 | Bouchard . | |
| 1,697,751 | 1/1929 | Blake . | |
| 2,152,648 | 4/1939 | Jones . | |
| 2,209,778 | 7/1940 | Krasowski . | |
| 2,302,259 | 11/1942 | Rothfuss . | |
| 2,606,106 | 8/1952 | Albertson . | |
| 3,863,412 | 2/1975 | Bodycomb et al. | 52/DIG. 13 |
| 4,216,620 | 8/1980 | Weder et al. . | |

*Primary Examiner*—David A. Scherbel
*Assistant Examiner*—Wynn E. Wood
*Attorney, Agent, or Firm*—Ross, Howison, Clapp & Korn

[57] ABSTRACT

A plant container cover includes flexible sheet material that is conformable to the shape of the plant container. The sheet material includes an exterior and an interior side wall; parallel top and bottom edges, and first and second ends. The interior side wall is disposed adjacent to the plant container. A flexible covering is provided for the sheet material and is disposed adjacent to the exterior side wall of the sheet material for completely covering the exterior side wall. A fastener is provided for detachably interconnecting the covering to the sheet material. The fastener is disposed adjacent to the top and bottom edges of the sheet material. Additionally, a fastener is provided adjacent the ends of the flexible sheet material for selectively interconnecting the ends such that the flexible sheet material encircles the plant container.

3 Claims, 1 Drawing Sheet

PLANT CONTAINER COVER

TECHNICAL FIELD OF THE INVENTION

This invention relates to plant containers, and more particularly to a decorative cover for plant containers.

BACKGROUND OF THE INVENTION

One existing method of containering plants consists of planting live plants in ceramic or plastic containers that may or may not have an integrated drain saucer on the bottom of the container. It is desirable that the container have a unique color or texture appearance to match with the decor, and color scheme of the room in which the plant is located. The plant container may be placed within a basket or wrapping material may be placed around the container in order to hide the drab appearance of the container.

A need thus exists for a plant container cover to provide a simple and aesthetically acceptable free-standing decor coordinating unit to cover containers used for live plants as well as artificial flowers or plants.

SUMMARY OF THE INVENTION

In accordance with the present invention, a plant container cover is provided. The cover includes flexible sheet material that is conformable to the shape of the plant container. The sheet material includes an exterior and an interior side wall; parallel top and bottom edges, and first and second ends. The interior side wall is disposed adjacent to the plant container. A flexible covering is provided for the sheet material and is disposed adjacent to the exterior side wall of the sheet material for completely covering the exterior side wall. A fastener is provided for detachably interconnecting the covering to the sheet material. The fastener is disposed adjacent to the top and bottom edges of the sheet material. Additionally, a fastener is provided adjacent the ends of the flexible sheet material for selectively interconnecting the ends such that the flexible sheet material encircles the plant container.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
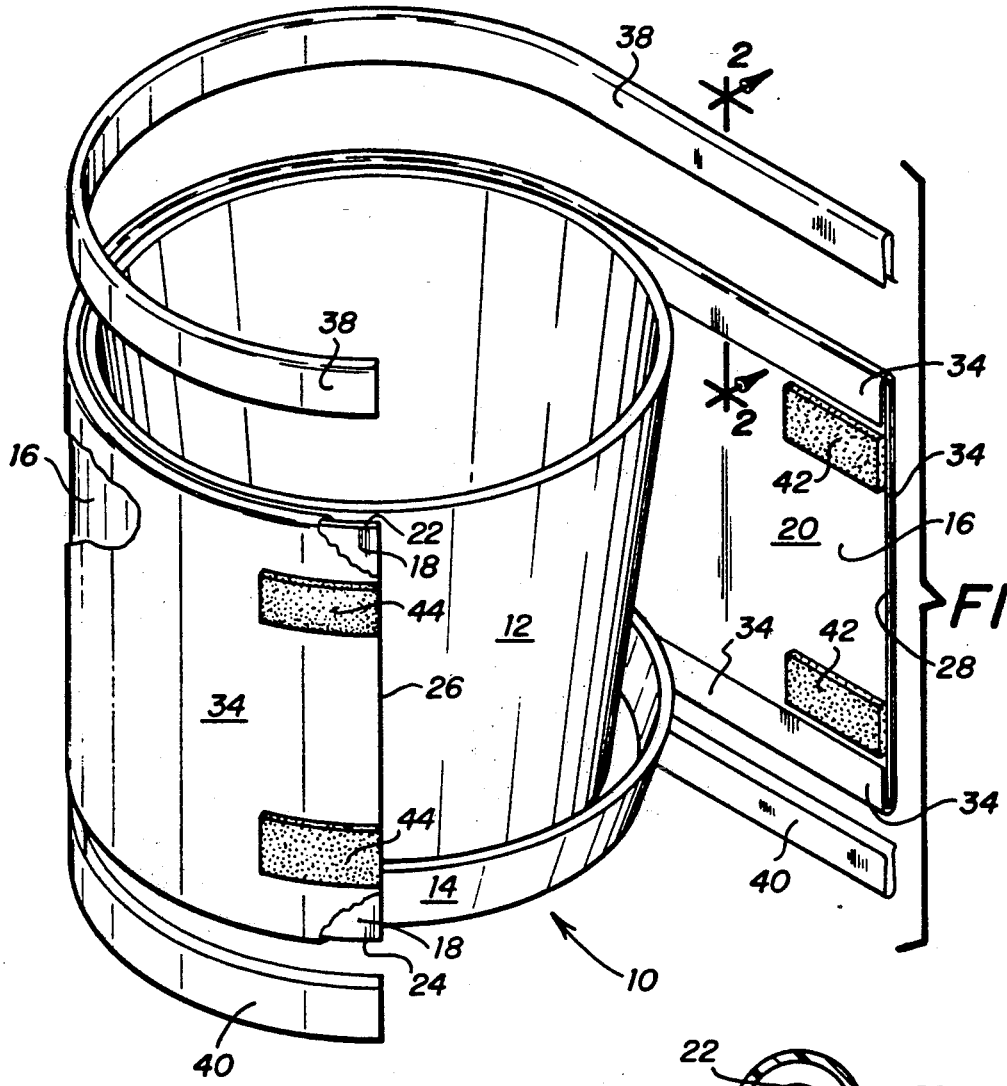
FIG. 1 is an exploded perspective view of the present plant container cover.
Figure 2:
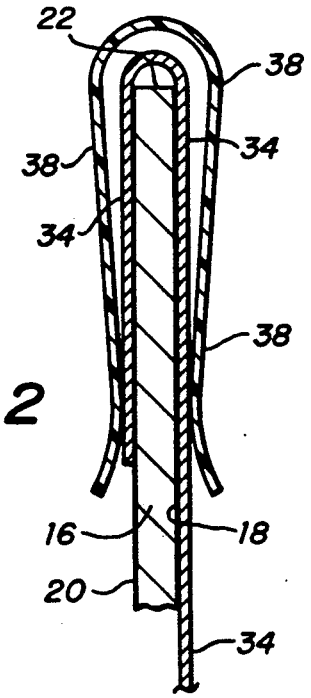
FIG. 2 is an assembled sectional view taken generally along sectional lines 2—2 of FIG. 1.

Referring simultaneously to FIGS. 1 and 2, the present plant container cover is illustrated, and is generally identified by the numeral 10. Plant container cover 10 is utilized for covering a plant container 12 having a drain watering saucer 14. Plant container cover 10 circumferentially surrounds plant container 12 when in use.

Plant container cover 10 includes a flexible sheet of material 16 which may comprise, for example, flexible plastic, wood strips, bamboo strips, metal, or other readily bendable material. Sheet material 16 includes an exterior side wall 18, an interior side wall 20, top edge 22, bottom edge 24, end 26, and end 28. Sheet material 16 is flexible to circumferentially surround plant container 12 when installed.

An important aspect of the present invention is the use of a covering 34 for selectively covering sheet material 16. Covering 34 is disposed adjacent to exterior surface 18 of sheet material 16, and may comprise, for example, fabric, wallpaper or other desired decorative material selected in accordance with the decor of the room in which plant container 12 is located. A portion of covering 34 extends over the top and bottom edges, 22 and 24, respectively and lies adjacent to interior surface 20 of sheet material 16.

Covering 34 is detachably interconnected to sheet material 16 utilizing top and bottom clips, 38 and 40, respectively. Clips 38 and 40 extend completely along the length of top and bottom edges 22 and 24, and function to easily attach covering 34 to sheet material 16. No adhesive or permanent securing device is required to attach covering 34 to sheet material 16 to allow for the easy removal and reattachment of a new covering 34 depending upon the decor desired. Both the entire top and bottom of covering 34 is completely attached to sheet material 16 to thereby provide a positive attachment of covering 34 to sheet material 16, as well as providing a neat and clean appearance for plant container 12.

Ends 26 and 28 of sheet material 16 are selectively interconnected to permit sheet material 16 to circumferentially surround container 12 and saucer 14 when installed. Interior side wall 20 of sheet material 16 includes strips 42 of Velcro fastener material. Strips 42 may be adhesively secured to interior side wall 20. Disposed adjacent to end 26 of sheet material 36 are mating Velcro strips 44 which are adhesively secured to covering 34 for mating with strips 42. Velcro strips 42 and 44 thereby permit ends 26 and 28 to be selectively joined and secured together so that sheet material 16 encircles plant container 12.

It therefore can be seen that the present plant container cover provides for a simple and aesthetically pleasing free-standing decor coordinating unit that will permit the selective attachment of various coverings for enclosing plant containers and saucers.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A plant container cover adapted to cover a plant container, said cover comprising:

flexible sheet material conformable to the shape of a plant container, said sheet material having interior and exterior side walls, parallel top and bottom edges, and first and second ends, said interior side wall being disposed adjacent to a plant container and said sheet material being slideably disposed around a plant container;

a flexible covering for said flexible sheet material being disposed adjacent to said exterior side wall of said sheet material for completely covering said exterior side wall and extending over said top and bottom edges of said sheet material;

first fastener means for detachably interconnecting said covering to said sheet material, said first fastener means being disposed adjacent to said top and bottom edges of said sheet material and including top and bottom edges respectively of said sheet material for engaging said covering on both said interior and exterior side walls of said sheet material; and second fastener means disposed adjacent said ends of said flexible sheet material for selectively interconnecting said ends, such that said flexible sheet material encircles a plant container.

2. The plant container cover of claim 1 wherein said second fastener means includes means disposed on said interior side wall of said flexible sheet material adjacent said first end thereof and means disposed on said covering adjacent said second end of said flexible sheet material for mating with said means disposed on said interior side wall.

3. The plant container cover of claim 2 wherein said second fastener means includes Velcro material.

* * * * *